US006591561B1

(12) United States Patent
Evensen

(10) Patent No.: US 6,591,561 B1
(45) Date of Patent: Jul. 15, 2003

(54) WATERPROOF ROOF DECK POST CONSTRUCTION

(76) Inventor: Lawrence P. Evensen, 29254 Greenwater Rd., Malibu, CA (US) 90265

( * ) Notice: Subject to any disclaimer, the term of this patent is extended or adjusted under 35 U.S.C. 154(b) by 0 days.

(21) Appl. No.: 09/240,807

(22) Filed: Feb. 1, 1999

(51) Int. Cl.[7] ..... E04H 12/28
(52) U.S. Cl. ..... 52/199; 52/219; 52/58; 52/60; 285/42
(58) Field of Search ..... 52/199, 58, 59, 52/60, 219; 285/83, 82, 42

(56) References Cited

U.S. PATENT DOCUMENTS

| | | | |
|---|---|---|---|
| 1,540,192 | A | 6/1925 | Smith |
| 3,977,137 | A | 8/1976 | Patry |
| 4,120,129 | A | 10/1978 | Nagler et al. |
| 4,211,423 | A | 7/1980 | Resech |
| 4,372,585 | A | 2/1983 | Evora |
| 4,453,562 | A | 6/1984 | Palkovics |
| 4,570,943 | A | 2/1986 | Houseman et al. |
| 4,897,974 | A | 2/1990 | Lane |
| 4,937,991 | A | 7/1990 | Orth |
| 5,010,700 | A | 4/1991 | Blair |
| 5,067,291 | A | 11/1991 | Evensen |
| 5,176,408 | A | 1/1993 | Pedersen |
| 5,222,334 | A | 6/1993 | Hasty |
| 5,226,263 | A | 7/1993 | Merrin et al. |
| 5,347,776 | A | 9/1994 | Skoff |
| 5,536,048 | A | 7/1996 | Orr |
| 5,588,267 | A | 12/1996 | Rodriguez et al. |
| 5,603,187 | A | 2/1997 | Merrin et al. |
| 5,605,019 | A | 2/1997 | Maziekien et al. |
| 5,778,611 | A | 7/1998 | Michel |
| 5,970,667 | A | 10/1999 | Thaler |

OTHER PUBLICATIONS

Prior Art Publication entitled "All Style Industries Waterproof Line Set Collars", one page.
Prior Art Publication entitled "Been Sued yet?" by All Style Industries, two pages.

*Primary Examiner*—Carl D. Friedman
*Assistant Examiner*—Jennifer I. Thissell
(74) *Attorney, Agent, or Firm*—Oppenheimer Wolff & Donnelly LLP

(57) ABSTRACT

A deck post (or brace) having a non-circular cross-section is secured in place by bolting its mounting bracket to the roof deck. A lead pipe jack is slid over the post, and its lower flange is nailed to the deck. A waterproofing assembly having a collar and a skirt is provided; the collar has an opening with generally the same non-circular cross-section as that of the post. The collar opening is positioned on the deck post, and the unit is slid down the post until the collar is at the top of the lead pipe jack and the skirt extends down over it. A stainless steel hose clamp is then positioned and tightened around the collar to provide a watertight seal on the deck post. When the post is already installed on a roof deck and the jack and the waterproofing assembly cannot be slid into place on the post, a modified waterproofing assembly and jack are used to provide the waterproofing. The modified jack is a prior art split lead flashing jack with an open seam on one side. The jack is opened up, wrapped around the post and soldered closed. The modified waterproofing assembly has a split joint through the skirt and collar. To position this assembly on the post at the top of the split lead flashing jack, the joint is opened up, the assembly wrapped around the post and the slip joint closed with a watertight flap. A snap-fit closure can be provided. A further alternative waterproofing assembly forms the collar as a plug separate from the skirt; the skirt is opened and the plug inserted therein. This arrangement allows a plug having the desired opening configuration to be selected from an inventory of different plugs and used with a single skirt design.

21 Claims, 15 Drawing Sheets

128
260
11
214

218
222
254
11
250
128
238
226
210
246
214
218
222
242

234
226'
222
210
230
218
128

270

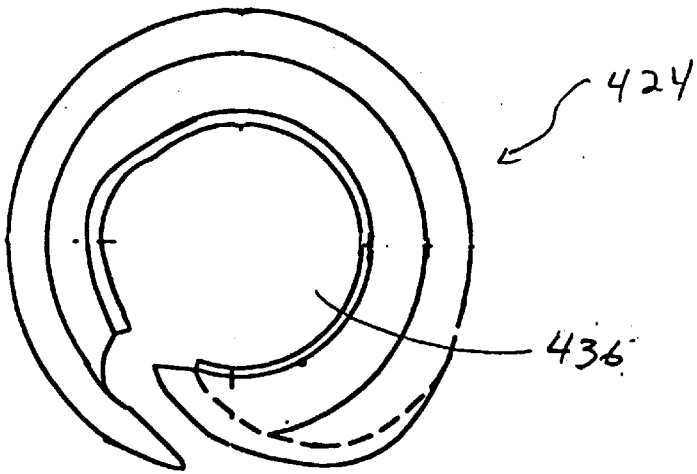
FIG. 21
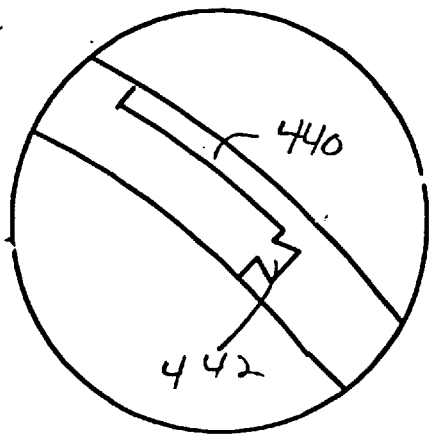
FIG. 22
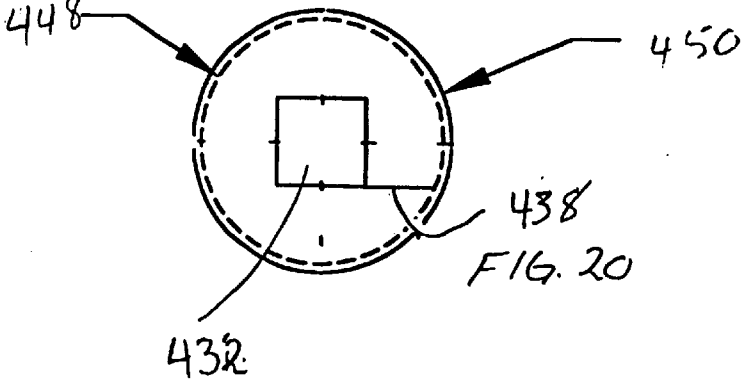
FIG. 20
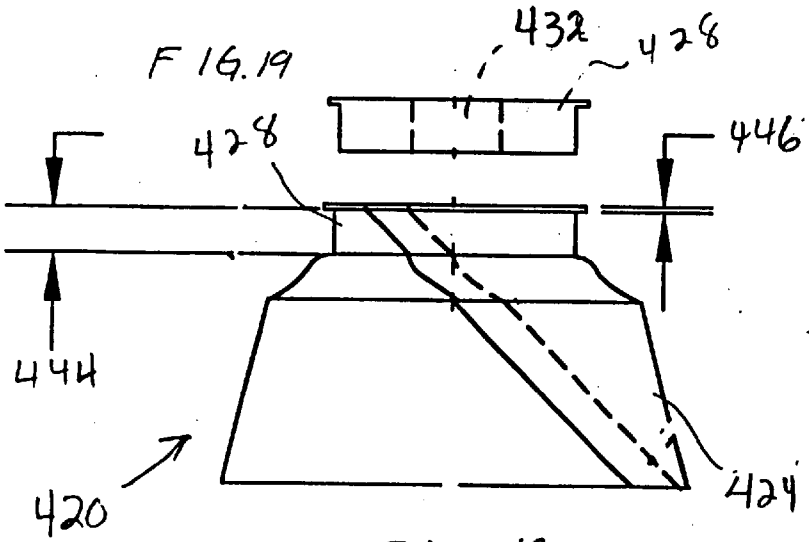
FIG. 19
FIG. 18

WATERPROOF ROOF DECK POST CONSTRUCTION

BACKGROUND OF THE INVENTION

The present invention relates to constructions and methods for installing and waterproofing roof deck posts, and particularly those having non-circular cross-sections.

The tops of buildings or roof decks are often used to mount various items, which typically support the use or function of the building or benefit the building's occupants in some way. These items include signs, fences, helicopter landing zones, equipment supports and even swimming pools.

When a fence, for example, is installed on top of a building, it must be installed securely so that it will not fall or blow off of the building. Additionally, the support members or posts of the fence must be attached in such a way as to maintain the water integrity of the roof. If the fence supports are bolted into the roof deck, each support will cut through or penetrate the building roof jeopardizing the water integrity of the roof unless adequate waterproofing measures are taken.

A waterproofing construction of the prior art used when the support or post is round is shown in FIG. 1 generally at 50. Referring thereto, the round post 54 is secured to structural framing 58, and is provided to support another structure such as fencing or a structural frame. An umbrella overlapping jack 64 is used to waterproof the support. The pipe jack 64 is a cone that fits snugly around the penetration and creates a waterproof seal above the roof line. FIG. 1 shows a sheet metal roof jack 66 extending at least eight inches above the roofing, and the umbrella pipe jack 64 overlaps the roof jack by a radius of three to four inches. A drawband 70 secures the upper collar portion of the pipe jack 64 to the round post 54, and caulk with sealant is applied around the top circumference. Construction 50 works where the projection or post is round; however, if the post is other than round, the pipe jack does not fit snugly and leaks result.

Thus, for other than round posts, another waterproofing construction is used, an example of which is depicted in FIG. 2 and is commonly referred to as "Pitch Pocket." This term describes the encasing of an odd-shaped penetration (such as a steel angle iron support) in a pool of asphalt that is held in a metal bowl mounted onto the roof. When the asphalt dries or cools the penetration located inside of it is tightly encased to prevent water penetrating into the building.

Referring to FIG. 2, a method of installing the Pitch Pocket will now be described with the construction being shown generally at 76. A steel angle iron brace (support or post) 80 with a four hole mounting plate 84 welded thereto is bolted with bolts 88 to a roof deck 90. A sheet metal contractor slides a four-sided metal pitch pan 92 over the top of the brace 80. The pan 92, which is at least two inches deep, hangs loose waiting for a later installation step. The roofing contractor installs first ply layers (typically three) of roofing materials under the pitch pan 92 and onto the entire building roof. He then nails the flange 94 of the pan 92 onto the roof deck and through the ply layers. Roofing plies will be striped or layered over the flange 94 to laminate the flange between the roofing plies. A finish coat of roofing materials 96, such as gravel or granule rolled roofing, is installed. Hot asphalt 98 or other pourable sealer is then poured into the pitch pan 92 until full and with a minimum two inch depth, and the asphalt is allowed to cool.

Pitch Pockets (76) work well until the asphalt shrinks or cracks and the pan or concave bowl fills with water. This cracking can be caused by the sun's direct heat, by impact on the post construction, by strong winds or by the building shaking as from an earthquake. When the cracks form the water in the pocket is funneled into the building, resulting in the problem which the pitch pocket was specifically provided to prevent. Also, since the post is fixed in place by the asphalt, when a strong force is exerted on the post, the asphalt around the post compresses, loosening the securement of the post relative to the roof, and requiring repair.

SUMMARY OF THE INVENTION

Directed to remedying the problems and disadvantages of the prior art, disclosed herein are an improved waterproof deck post construction and method and a waterproofing assembly (or watertight umbrella) useful therein. The assembly has a collar with an opening therethrough and a skirt hanging down from the collar. The opening is configured to match the cross-sectional shape of the deck post, and this invention is thereby particularly well suited for deck posts which are not round. The assembly is preferably an elastomeric material or specifically is EPDM molded rubber.

The post is secured to the roof deck. A flanged sleeve is slid over the post and the flange secured to the roof deck. The flanged sleeve can be a lead jack such as are used today on stink pipes and vent pipes. The waterproofing assembly is slid onto the post. With the collar surrounding the post just above the top of the sleeve and the skirt extending down over the top of the sleeve, a band is secured around the collar securing the collar in a watertight manner to the post. The band is preferably a hose clamp.

When the post is already secured to the deck and it is not convenient to slide the waterproofing assembly down over the post, an alternative embodiment of the waterproofing assembly of this invention is used. This embodiment has a split joint through the skirt and the collar which allows the unit to be opened up and wrapped around the post. A watertight flap of the unit seals the joint closed. In this construction, a split lead flashing jack can be used as the flanged sleeve. The flashing jack is opened up and wrapped around the post and its seam then soldered closed.

The shape of the opening of the collar is selected to match the shape of the outside surface of the post. For example, it can be an L or a square shape. The skirt can have the same configuration for all post shapes. Thus, another embodiment of the waterproofing assembly constructs the skirt and collar as separate pieces with an inventory of collars having different opening shapes provided. The collar with the desired opening shaped to match the post being used will be selected and plugged into the skirt. In other words, the detachable EPDM collars or inserts are interchangeable to allow various geometric shapes. This plug-type collar and skirt can have split joints allowing them to be wrapped around the post. Additionally, the collar can have a longer configuration to accommodate two hose clamps, one above the other, if desired.

Other objects and advantages of the present invention will become more apparent to those persons having ordinary skill in the art to which the present invention pertains from the foregoing description taken in conjunction with the accompanying drawings.

BRIEF DESCRIPTION OF THE DRAWINGS

FIG. 18 is a view similar to FIG. 14 illustrating an alternative waterproofing assembly of the present invention;

FIG. 19 is a side elevational view of the plug of the assembly of FIG. 18;

FIG. 20 is a top plan view of the plug of FIG. 19;

FIG. 21 is a top plan view of the assembly of FIG. 18 without the plug and in an open position;

FIG. 22 is an enlarged view of a portion of the seam of FIG. 18;

DETAILED DESCRIPTION OF PREFERRED EMBODIMENT OF THE INVENTION

Figure 1:
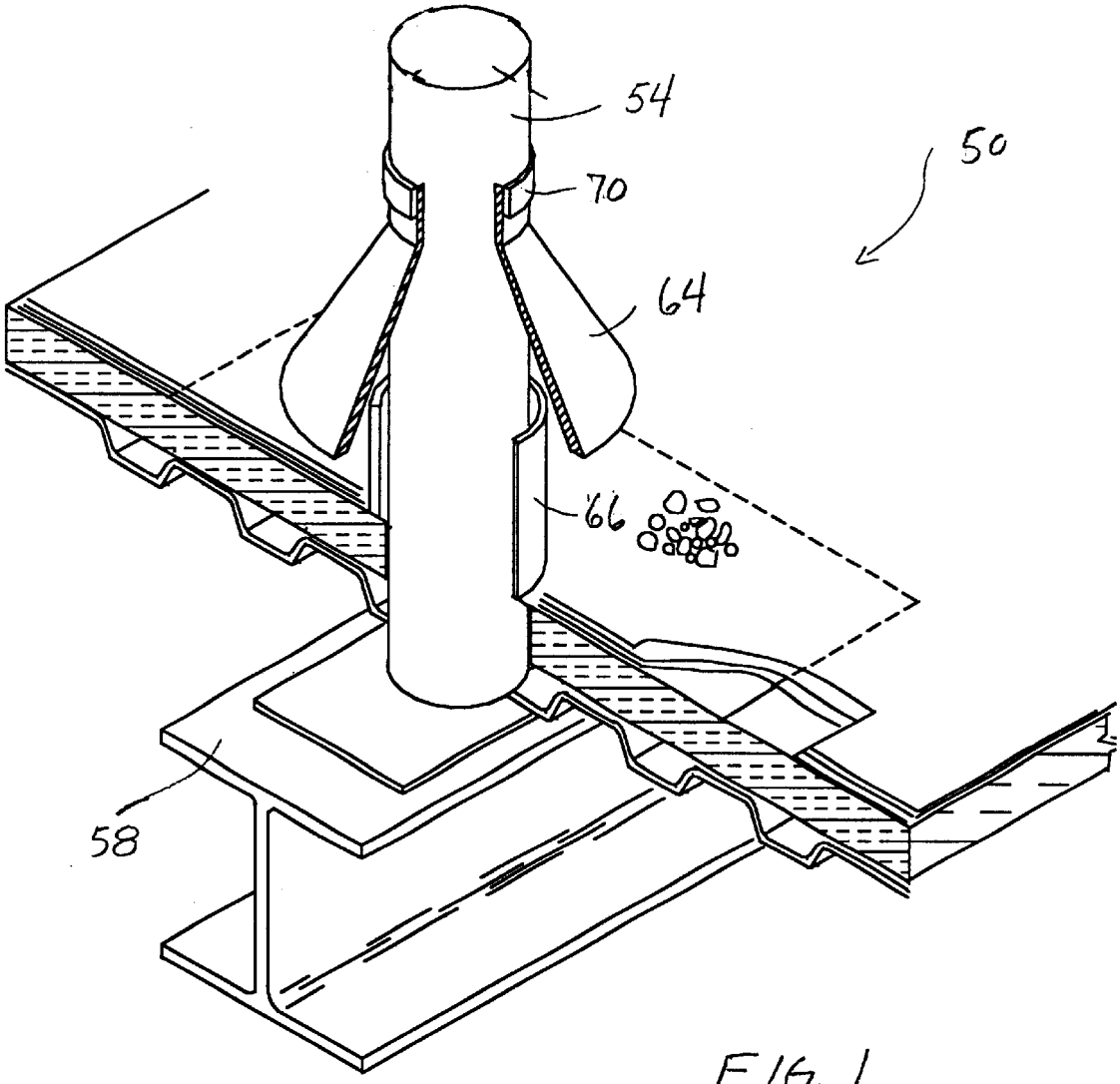
FIG. 1 (PRIOR ART)
FIG. 1 is a perspective cut-away view of a round post roof-mounted construction of the prior art.
Figure 2:
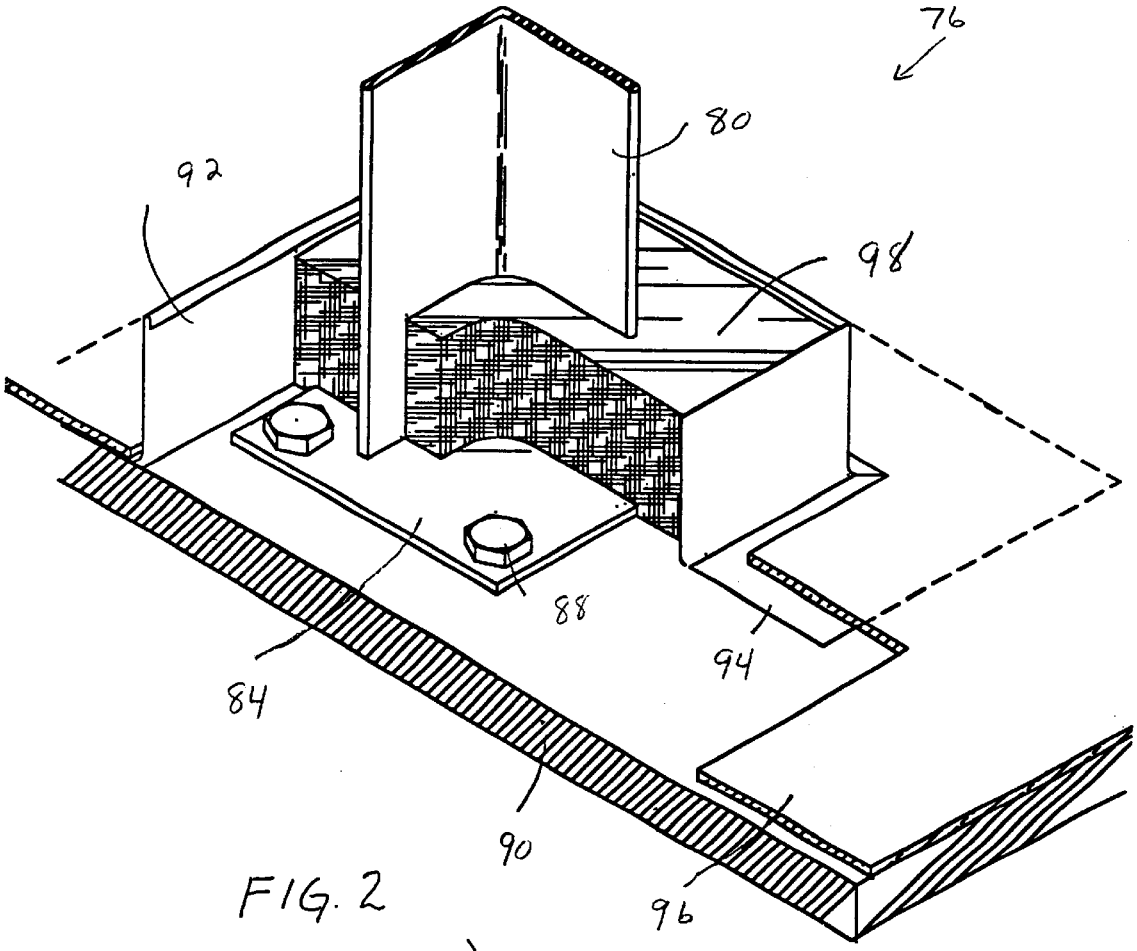
FIG. 2 (PRIOR ART)
FIG. 2 is a perspective cut-away view of an angle iron brace roof-mounted ("Pitch Pocket") construction of the prior art.
Figure 3:
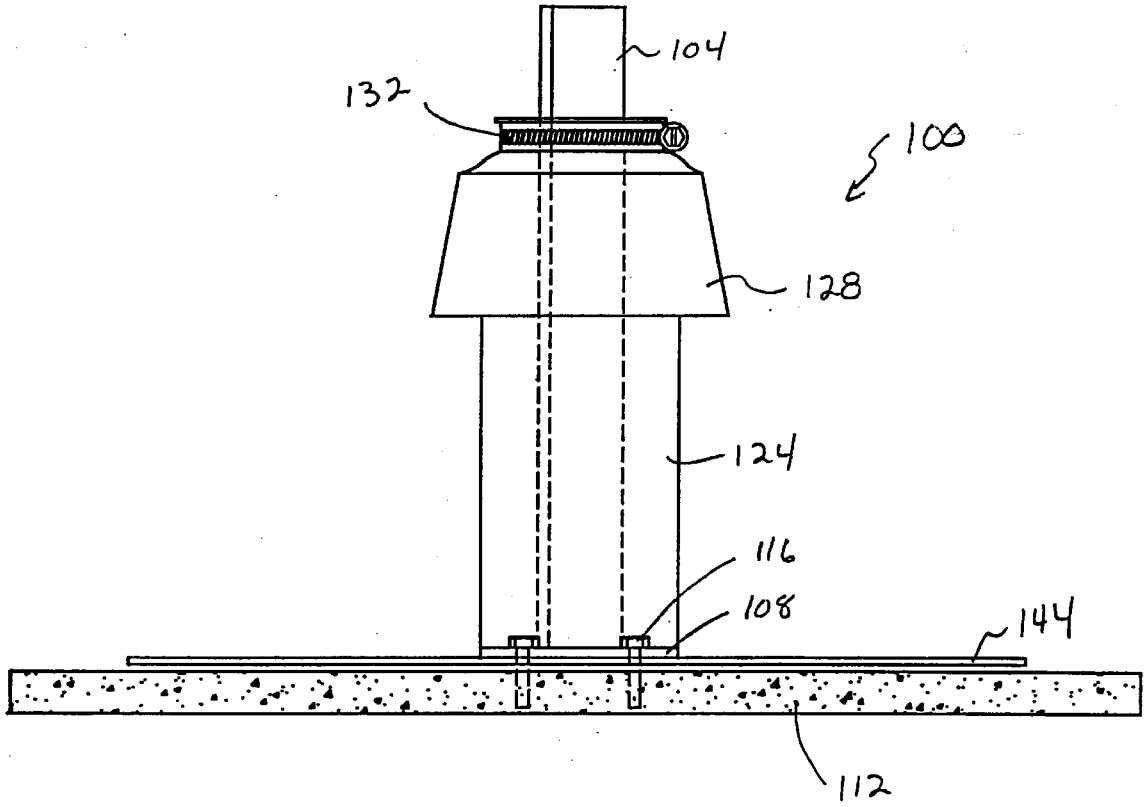
FIG. 3 is a side elevational view of a waterproof roof deck construction of the present invention.
Figure 4:
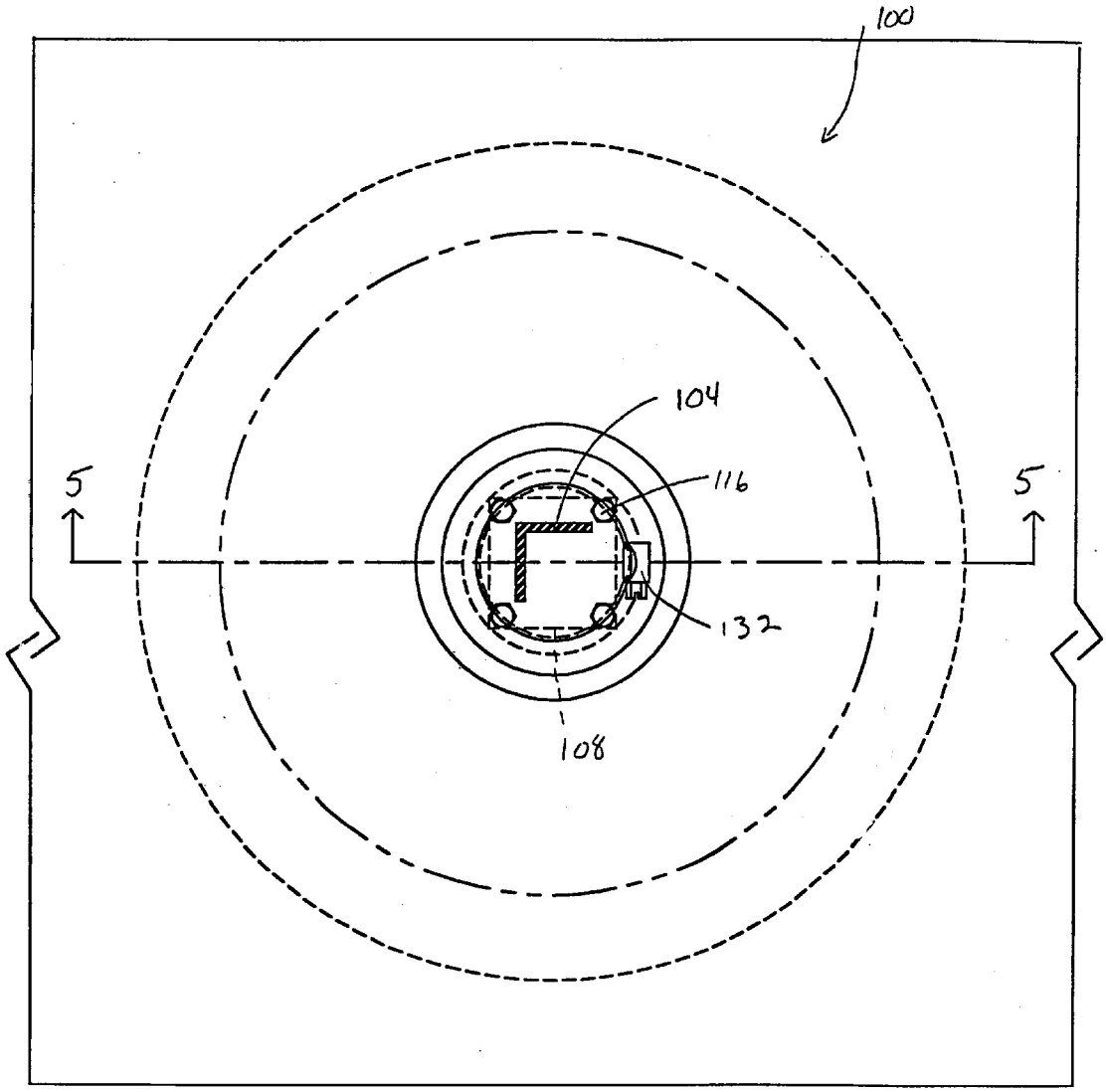
FIG. 4 is an enlarged top plan view of the construction of FIG. 3.

Referring to the drawings, a waterproof roof deck post construction of the present invention is illustrated generally at 100. The method of constructing it is quick and easy. The steel contractor bolts the post 104 with a four-hole mounting bracket 108 welded thereto to the roof deck 112 using bolts 116. The post 104 can have generally any cross-sectional shape (unlike the prior art of FIG. 2) including non-round shapes. An "L" shape is illustrated by post 104, which more specifically is an angle iron brace. The steel contractor then slides a lead pipe jack 124, a waterproofing assembly 128 of the present invention and a stainless steel hose clamp 132 over the top of the brace or post 104 and lets them fall to the deck for later installation.

Figure 6:
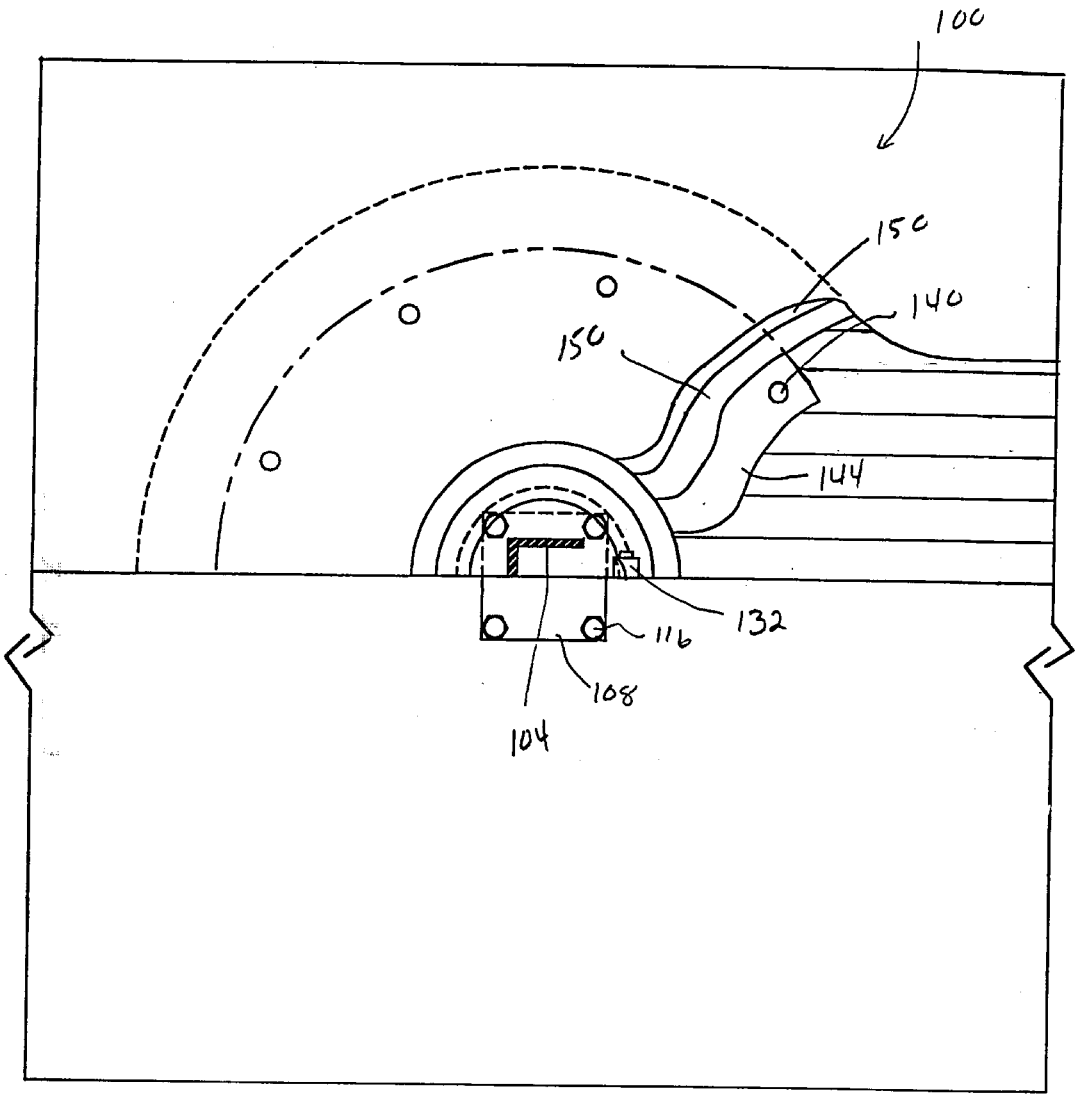
FIG. 6 is an enlarged top plan view of FIG. 5.
Figure 7:
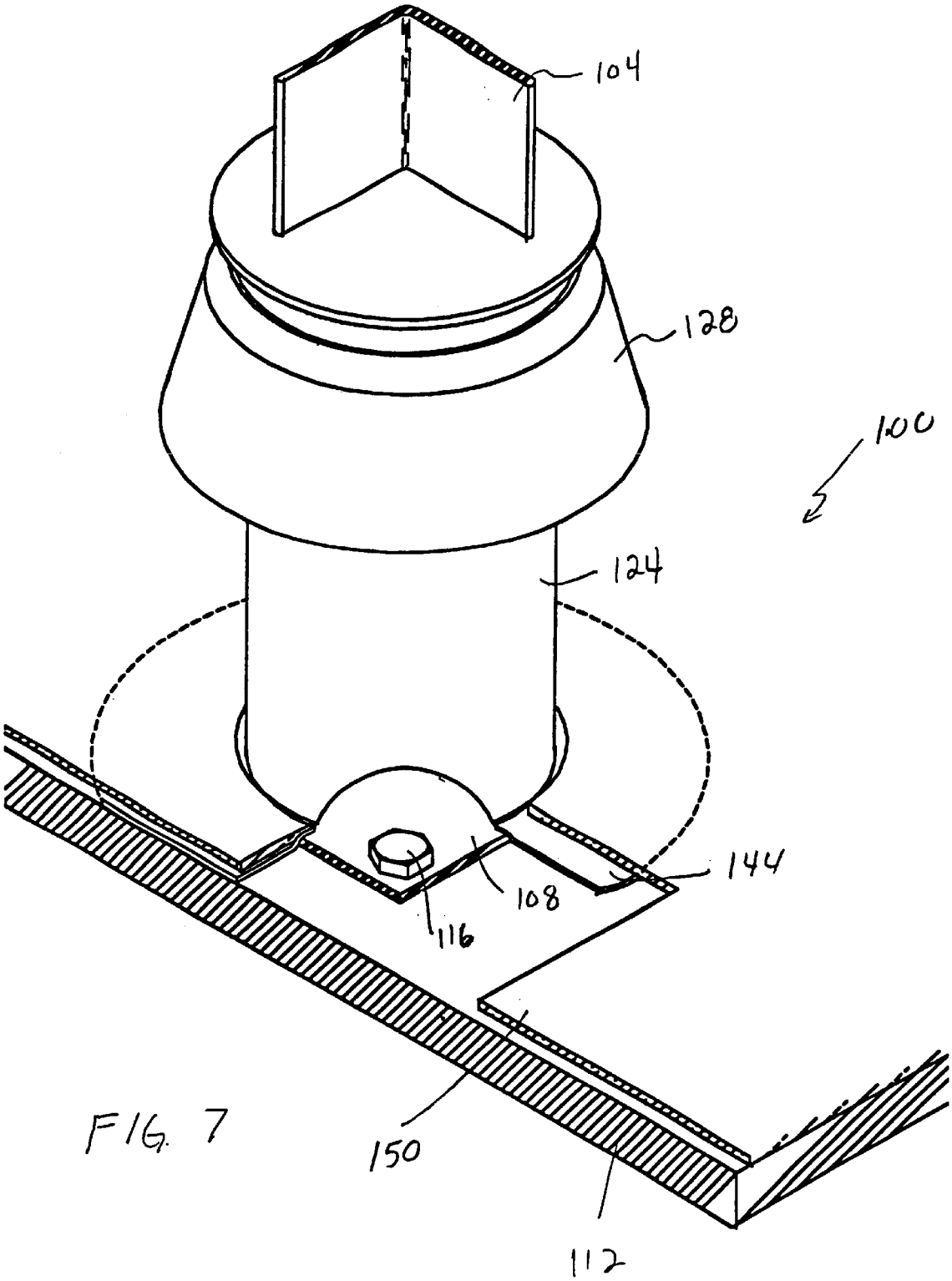
FIG. 7 is a perspective, partially cut-away view of the construction of FIG. 3, but without the hose clamp for illustrative purposes.

Next, the roofing contractor installs roofing plies (typically three plies) over the entire building. He nails with nails 140 (FIG. 6) the flange 144 of the lead pipe jack 124 through the ply layers and into the roof deck 112. The lead pipe jack 124 will typically have a three or four inch diameter and a four pound lead thickness. Instead of a lead jack, a cheaper standard galvanized steel roof jack can be used. Roofing plies 150 are stripped over the flange 144 thereby laminating the flange into the roof system. The finish layer of roofing materials (such as gravel or granule roll roofing) are installed over the ply layers.

Figure 5:
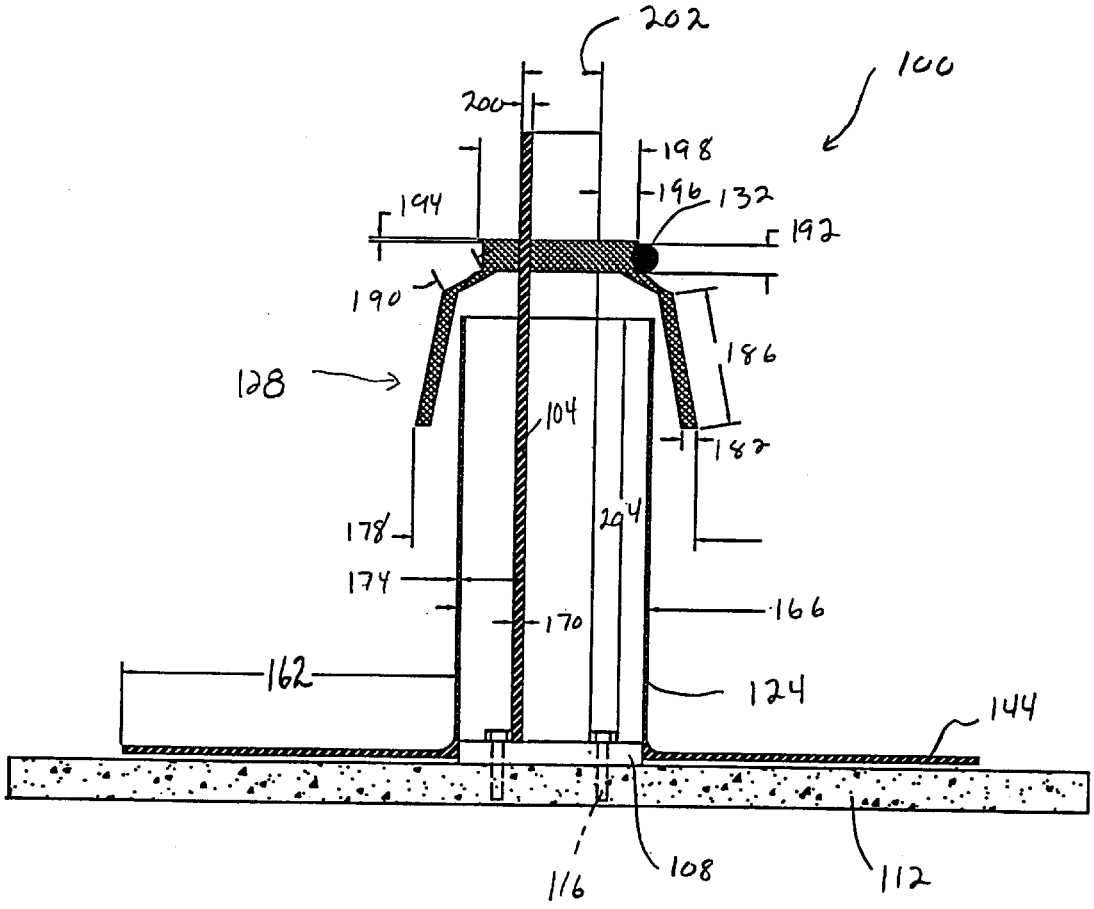
FIG. 5 is a reduced cross-sectional view taken on line 5—5 of FIG. 4.

The roofing contractor then slides the waterproofing assembly 124 over the leak flashing with its cone shape facing down. The stainless steel hose clamp 132 is placed in position on the waterproofing assembly and the clamp 158 tightened down. FIG. 5 shows dimensions 162, 166, 170, 174, 178, 182, 186, 190, 192, 194, 196, 198, 200, 202, 204 of 6.27, 3.64, 0.20, 0.07, 5.27, 0.25, 2.54, 0.80, 0.53, 0.07, 0.75, 3.04, 0.20, 1.50, and 7.87 inches, respectively. These are just sample dimensions, however, and it is within the scope of the invention to change dimensions, style, materials and heights above the roof deck as would be apparent to those skilled in the art.

Figures 9, 10, 11:
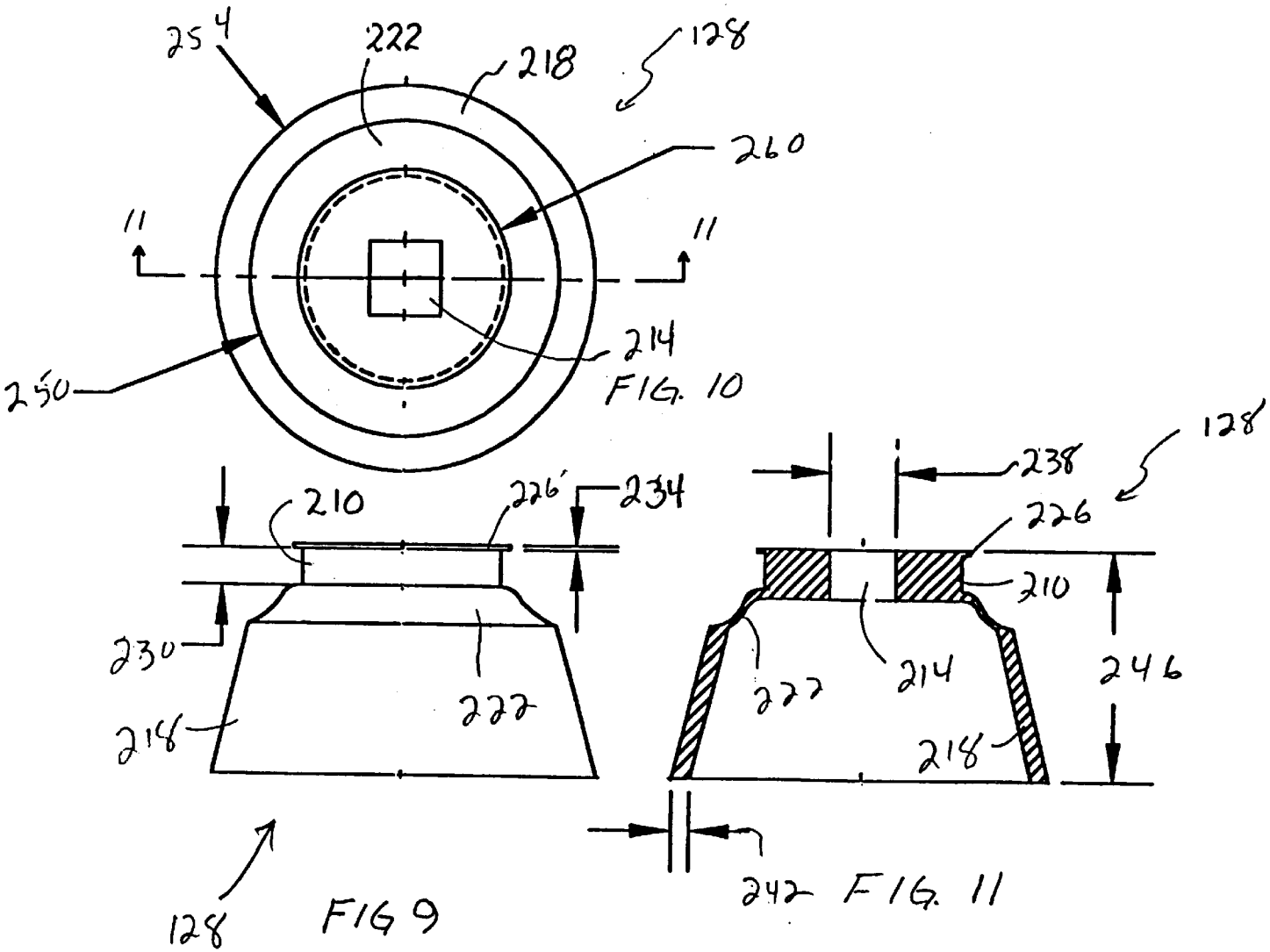
FIG. 9 is a side elevational view of an alternative waterproofing assembly of the present invention usable in the construction of FIG. 3, for example.
FIG. 10 is a top plan view of the unit of FIG. 9.
FIG. 11 is a cross-sectional view taken on line 11—11 of FIG. 10.

The waterproofing assembly 128 is shown in isolation in FIGS. 9, 10 and 11. It is seen therein that it has a collar portion 210 having an opening 214 therethrough, a downwardly-depending skirt 218, a shoulder 222 connecting the collar with the skirt, and a top rim or flange 226. These components according to one embodiment of this invention are integrally formed of EPDM molded rubber in a thermal process. This elastomeric construction allows the collar portion 210 to be squeezed by the hose clamp 132 to secure in a watertight manner the collar to the post 104, preventing water from leaking between the opening and the post. Sample dimensions 230, 234, 238, 242, 246, 250, 254 and 260, 0.51, 0.06, 1.00, 0.25, 3.11, R2.15, R2.63 and R1.50 inches, respectively, are shown in these figures.

Figure 8C:
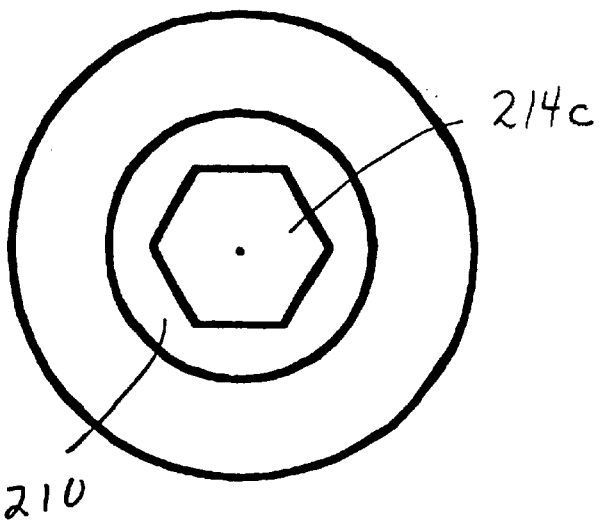
FIGS. 8*b* and 8*c* are first and second alternative designs, respectively, of the unit of FIG. 8*a* to accommodate posts of different corresponding cross-section configurations.
Figure 8B:
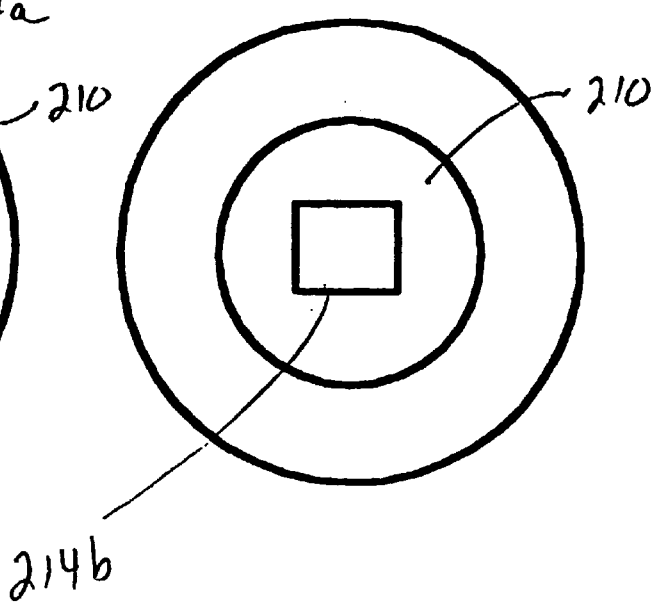
Figure 8A:
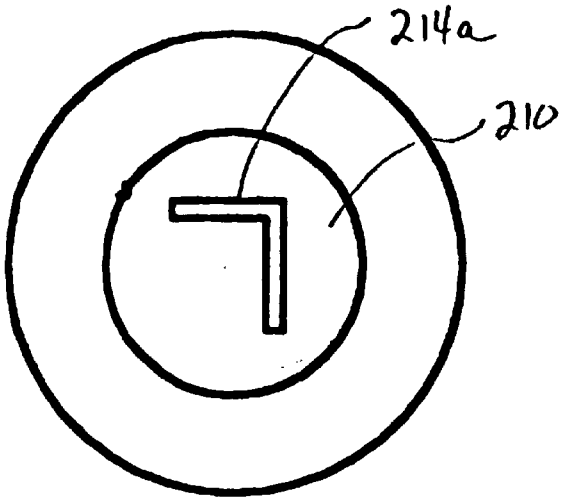
FIG. 8*a* is a top plan view of the waterproofing assembly of the construction of FIG. 7.

The opening 214 will be configured to have the same shape as the cross-section of the post (brace) 104 to which it is to be attached. Common shapes for the openings 214 are illustrated in FIGS. 8*a*, 8*b* and 8*c* as L shaped, square and hexagonal, respectively, at 214*a*, 214*b* and 214*c*.

Figure 16:
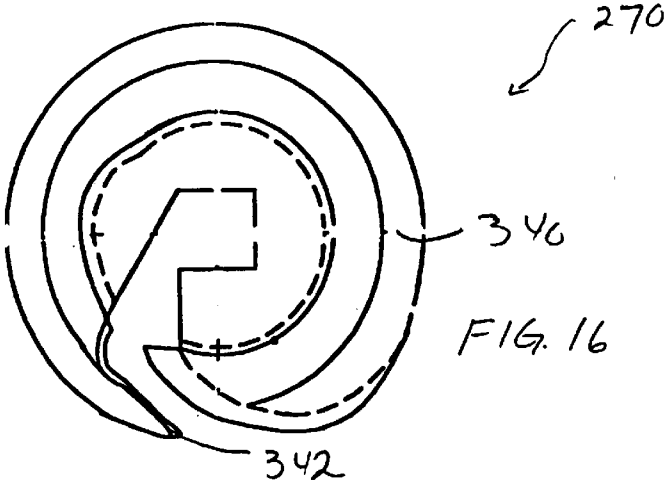
FIG. 16 is a view similar to FIG. 15 illustrating the unit in an open position.
Figure 15:
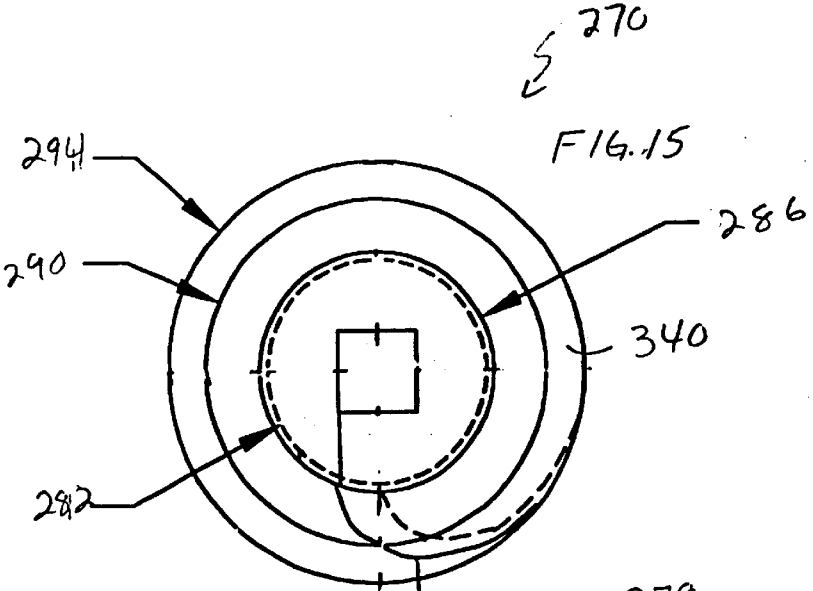
FIG. 15 is a top elevational view of the unit of FIG. 14.
Figure 14:
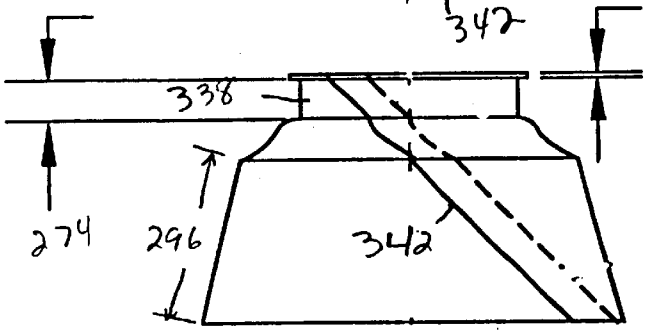
FIG. 14 is a view similar to FIG. 9 illustrating an open seam waterproofing assembly of the present invention.
Figure 24:
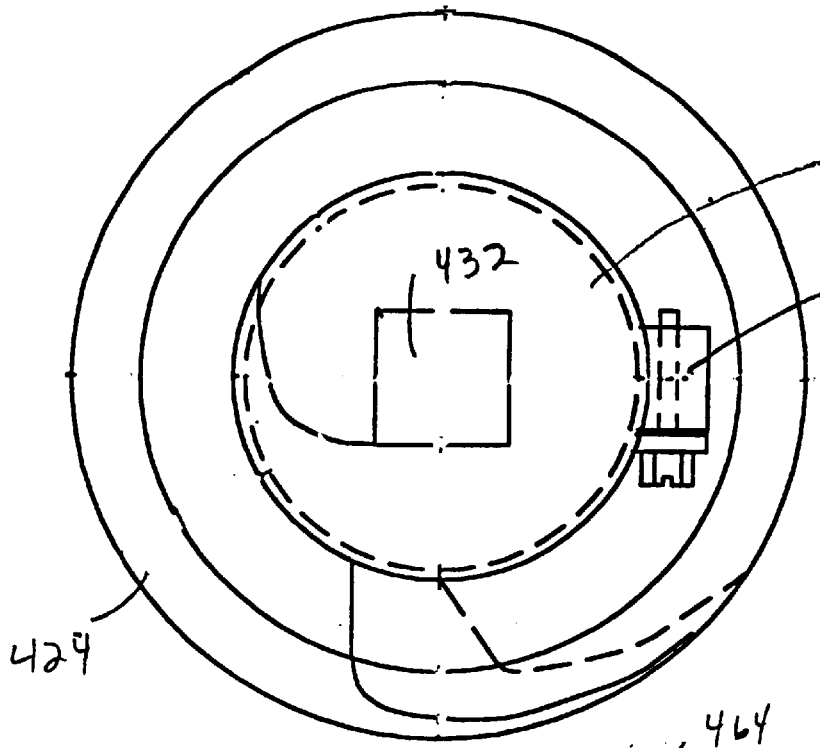
FIG. 24 is a top plan view of the unit of FIG. 23 with the hose clamps.
Figure 27:
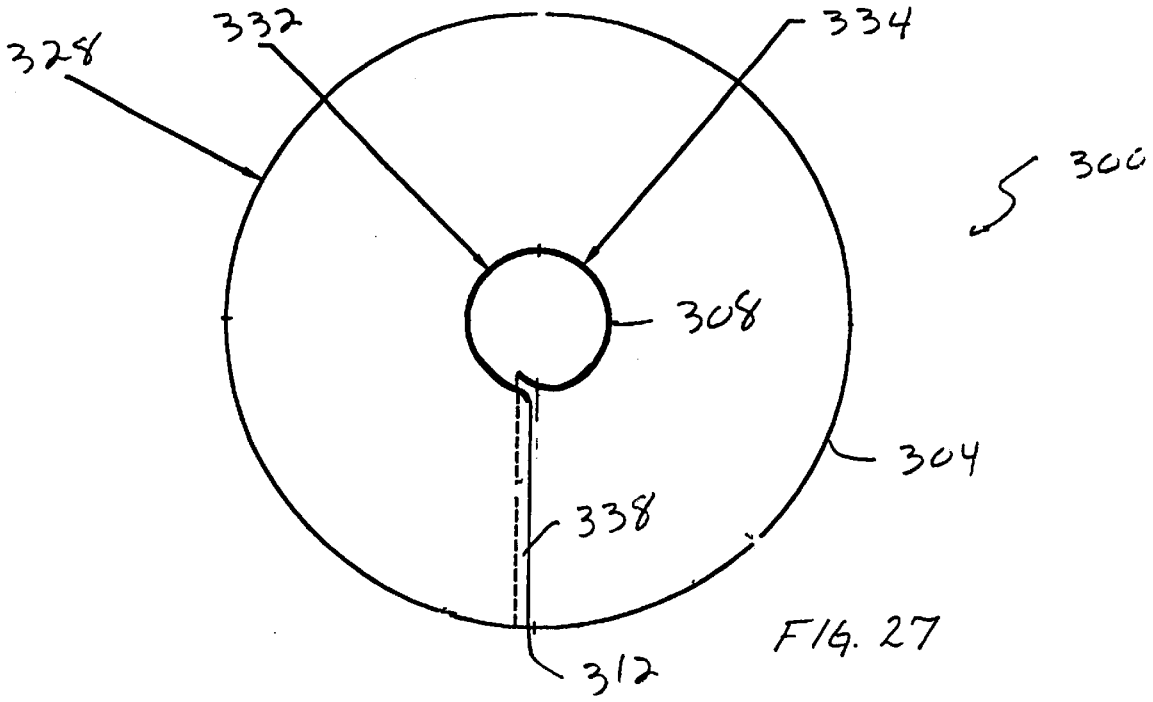
FIG. 27 is a top plan view of the split lead pipe jack of FIG. 26.
Figure 26:
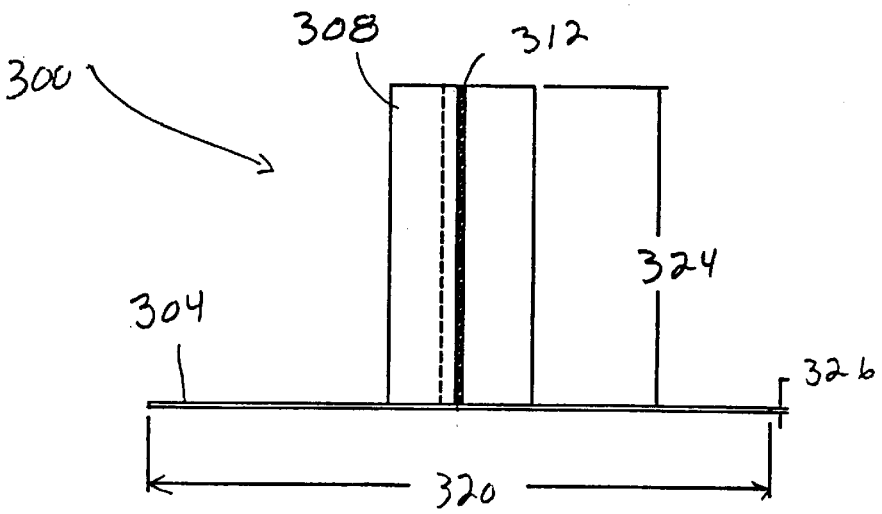
FIG. 26 is a side elevational view of a split lead pipe jack usable with the waterproofing assemblies of FIGS. 14, 18 and 23, for example, in a waterproof roof deck construction like that of FIG. 3.

If a post 104 (angle iron or other shaped brace) is already on a building and the waterproofing assembly 128 cannot be slid into position, a retrofit waterproofing assembly of this invention can be used as depicted in FIGS. 14–16 generally at 270. It has dimensions 274, 278, 282, 286, 290, 294 and 296 of 0.51, 0.06, R1.38, R1.50, R2.15, R2.63 and 2.10 inches, respectively. It is used together with a split lead flashing jack (which is a commercially available product) as illustrated generally at 300 in FIGS. 26 and 27. As shown in FIGS. 26 and 27, the split lead flashing jack 300 has a bottom flange 304 at the bottom of the sleeve 308, and an open seam 312 extends all of the way down the side. The split lead jack 300 can be a standard jack which is cut at the site to allow installation or it can be a special pre-cut jack. The split lead jack 300 has preferred dimensions 320, 324, 326, 328, 332 and 334 of 15.50, 8.00, 0.125, R7.750 and R1.750, R1.813 inches, respectively.

The lead jack 300 is pulled open and wrapped around the existing support post (104). The lead metal of the jack 300 is soft enough to allow the jack to be opened and closed without using a separate hinge. The open seam 312 is then silver soldered closed with a propane torch. Lead, material 338 overlaps to facilitate soldering.

Similar to construction 100, the roofing contractor installs his ply sheets and the flange 304 of the lead jack 300 is nailed through the ply sheets to the roof deck. Extra ply sheets are stripped over the flange to laminate it into the roof systems. The finish layer of roofing materials are installed onto the roof plies.

Figure 17:
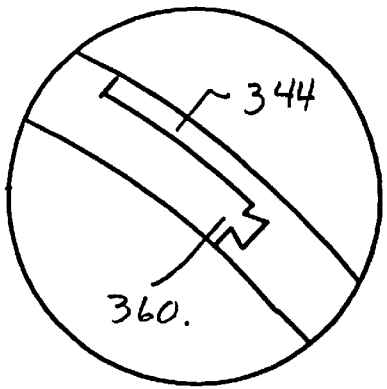
FIG. 17 is an enlarged view illustrating a portion of the seam of FIG. 14.

The retrofit collar 338 and skirt 340 of retrofit waterproofing assembly 270 is opened on its seam 342 and fit around the support post (104). With the assembly in place, the slip joint 344 on the collar 338 and skirt 340 is slid or snapped into place. The watertight flap 360 will be positioned facing downward, as shown in FIG. 17. A stainless steel hose clamp (132) is then positioned on the collar and clamped tight.

Figure 13:
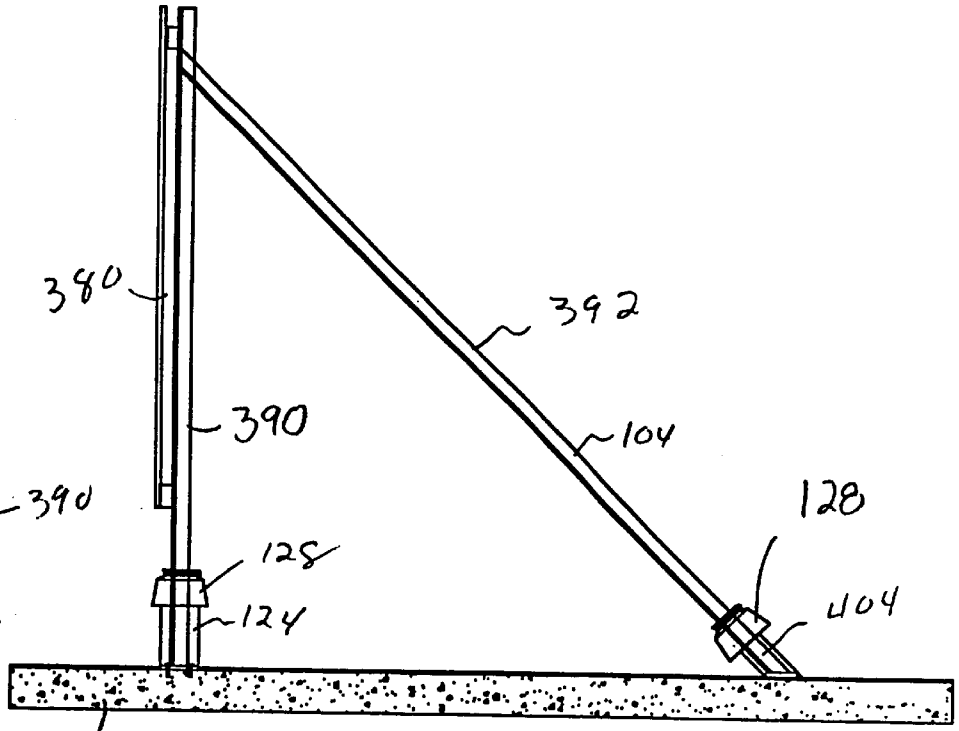
FIG. 13 is a side elevational view of the assembly of FIG. 12.
Figure 12:
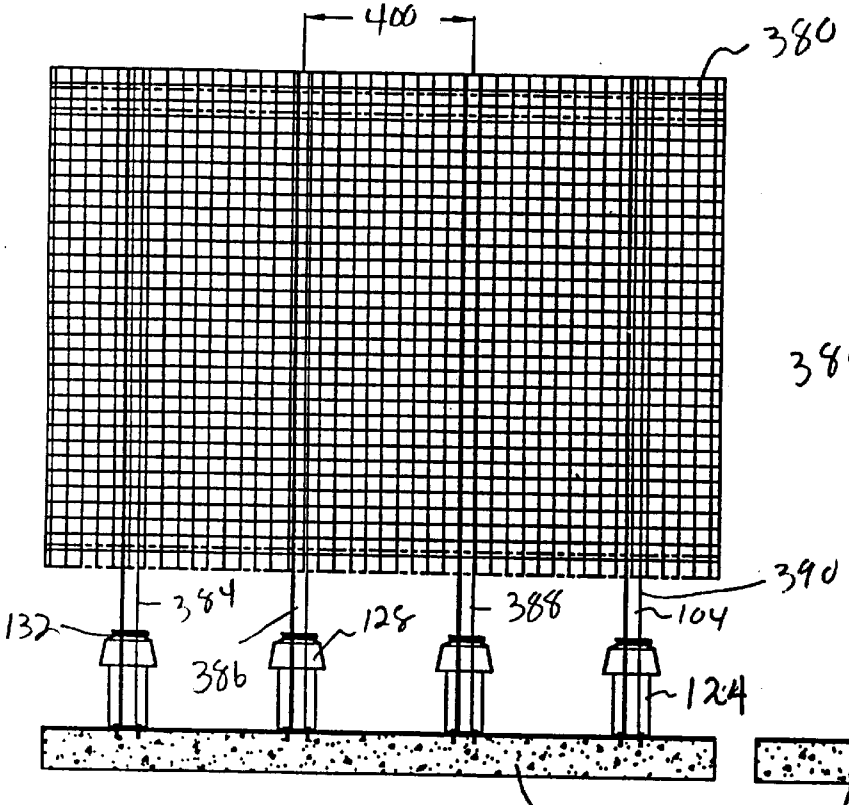
FIG. 12 is a side elevational view of a construction assembly of the present invention used to support rooftop fencing or screening structure.

The support post construction (100) of this invention using either waterproofing assembly 124 or retrofit waterproofing assembly 270 can be used to support generally any rooftop construction as is done today. An example is to support fencing or an equipment screen, as shown in FIGS. 12 and 13 generally at 380. Roof mounted equipment fences or screens are often used at the perimeters of buildings to hide roof mounted machinery from ground view. The design as shown uses four front upright posts 384, 386, 388, 390 and four angled constructions 392 of this invention. The four front upright posts 384, 386, 388, 390 are mounted about sixteen inches apart as shown by dimension 400. The angled (angle iron brace) constructions 392 are at a forty-five degree angle and are welded at their tops to the upright constructions. They have a forty-five degree lead jack 404 and use the same waterproofing assemblies 128 or 270 as discussed above.

Figure 25:
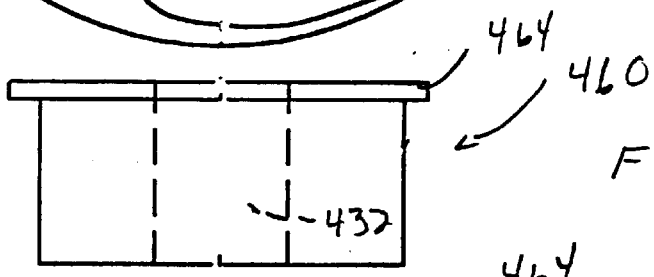
FIG. 25 is a side elevational view of the plug of the unit of FIG. 23 illustrated in isolation.
Figure 23:
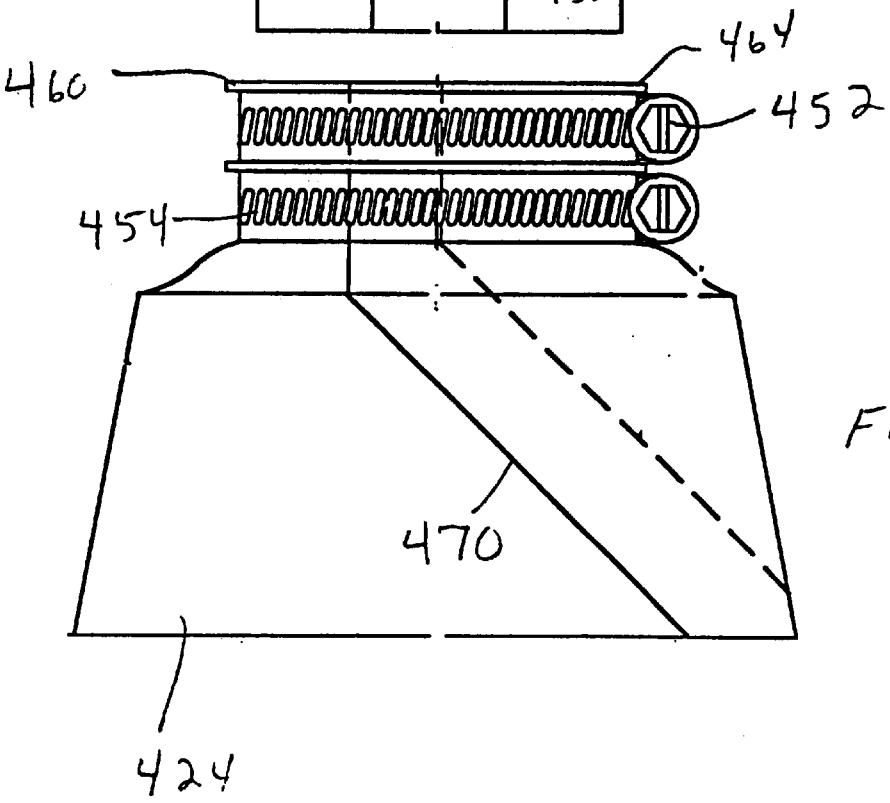
FIG. 23 is a side elevational view of another alternative waterproofing assembly of the present invention similar to that of FIG. 18 but with a detachable plug configured to accommodate two hose clamps as shown.

The collar portion of the waterproofing assembly can be formed as a separate unit from the skirt portion as shown in FIGS. 18–21 by waterproofing assembly 420. This can be for the standard or for the open-seam wrap around embodiments. This has the advantage that a single skirt portion 424 can be used for all types and shapes of support posts (104), and it is only the collar portion 428 with its different shapes of openings 432 (see FIGS. 8*a*, 8*b* and 8*c*) which varies. The separate collar 428 then acts like a plug to fit into the opening 436 at the top of the skirt 424 when pulled open as shown in FIG. 21. The collar 428 has a parting line 438 which opens to allow for installation. The slip joint 440 and watertight flap 442 are illustrated in the enlarged view of FIG. 22. Preferred dimensions 444, 446, 448, 450 are 0.51, 0.06, R1.38 and R1.48 inches, respectively. The (stainless steel) hose clamp (132) compresses and secures the plug 428 in place relative to the skirt 424 and the post (104). If needed, two clamps can be used, one above the other, as shown in FIG. 23 by hose clamps 452, 454. The two clamp embodiment will likely require a longer or taller collar (plug) 460 as depicted in FIG. 25.

The rim or flange 464 on the plug 460 allows for a positive stopping point when installing it into the construction. Also, it is a good waterproofing technique to let water that is flowing off the top of the plug 460 pass over the seam 470 of the collar and not into the seam. The flange 464 will overlap to the outside of the base of the collar.

Figure 30:
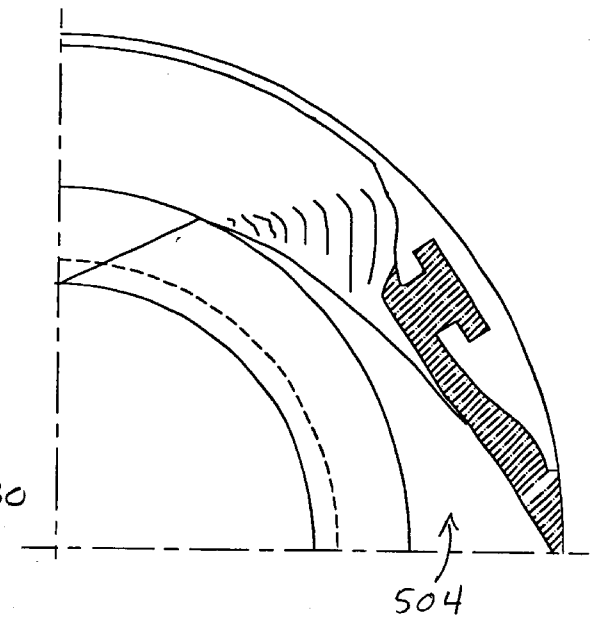
FIG. 30 is an enlarged, sectional bottom view of the slip joint of the assembly of FIG. 22.
Figure 28:
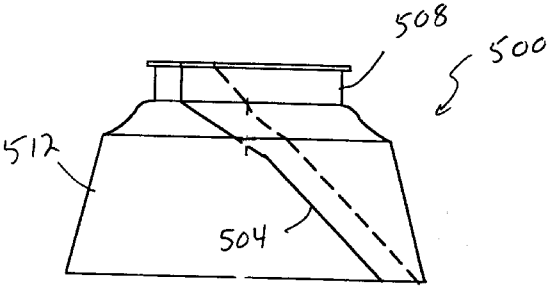
FIG. 28 is a view similar to FIG. 14 of an alternative assembly.
Figure 29:
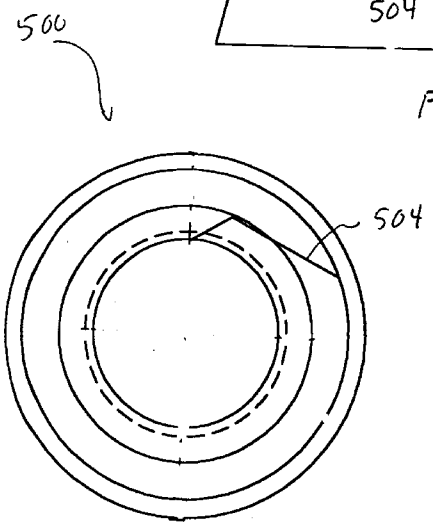
FIG. 29 is a bottom plan view of the assembly of FIG. 28.

FIGS. 28 and 29 show generally at 500 an alternative retrofit waterproofing assembly of this invention. It includes a slip joint 504 on the collar 508 and skirt 512. FIG. 30 is an enlarged view of the upper right portion of FIG. 29 showing in greater detail the slip joint 504 which allows the collar 508 to open.

Figure 31:
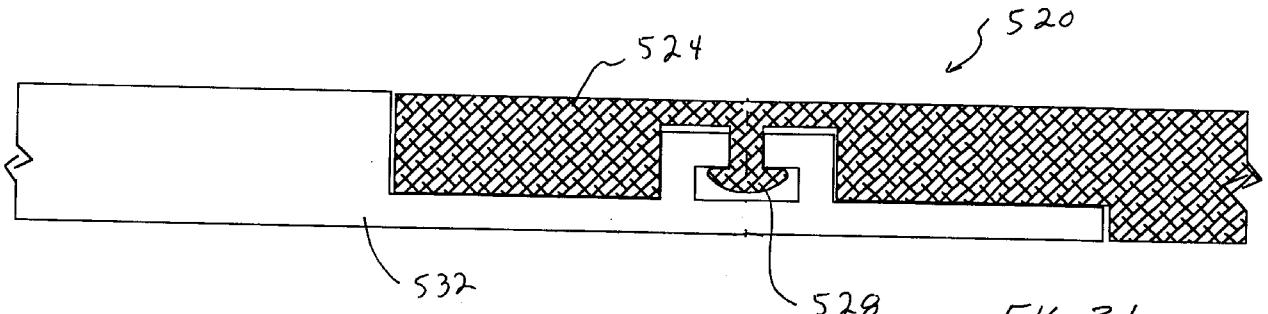
FIG. 31 is cross-sectional view of the snap-in slip joint.

Referring now to FIG. 31, an assembled EPDM rubber snap joint with flap is illustrated generally at 520 with the male insert 524 snapped with snap 528 into the female adapter 532. It functions generally similar to a ZIP LOCK bag. Unlike a typical plastic ZIP LOCK bag, the present assembly is made of rubber and its cross-section is different. Also, the snap and adapter areas are preferably made using a harder rubber than the rubber in the base collar. The collar is manufactured laying flat and then turned around to the point that the snap joint 520 can be pushed in by finger pressure. This is the only known roofing product that locks in place without tools.

Thus, the waterproof roof deck post constructions of this invention do not deform or shrink and thus prevent water from flowing into the roof penetration. Unlike the asphalt of the prior art Pitch Pocket, the waterproofing assembly will not crack over time requiring maintenance. The present constructions are also considerably cheaper and more attractive than the Pitch Pocket design. Additionally, the constructions of this invention are easier and quicker to install.

From the foregoing detailed description, it will be evident that there are a number of changes, adaptations and modifications of the present invention which come within the province of those skilled in the art. However, it is intended that all such variations not departing from the spirit of the invention be considered as within the scope thereof.

What is claimed is:

1. A waterproof roof deck post construction, comprising:

a deck post having a post cross-section and secured relative to a roof deck;

a sleeve surrounding a lower portion of the post;

a flange secured to a lower end of the sleeve and extending out therefrom, the flange being secured relative to the roof deck;

a waterproofing assembly including a collar and a skirt, the collar having an opening having generally the same cross-section as that of the post cross-section, the post being disposed in the opening, the collar surrounding the post above a top of the sleeve, and the skirt extending down from the collar and out over the top of the sleeve; and a band surrounding the collar and securing in a generally watertight manner the collar to the post; and the collar being formed as a plug which is a separate piece from the skirt and is adapted to be fitted into an opening in the skirt, and the plug having a seam that allows the plug to open and wrap around the deck post.

2. The construction of claim 1 wherein the post cross-section is non-circular.

3. The construction of claim 1 wherein the skirt is generally frusto-conical in shape, a lowermost perimeter edge of the skirt is spaced a distance above a top surface of the roof deck thereby exposing a portion of the sleeve between the edge of the skirt and the top surface of the roof deck.

4. A waterproofing assembly, comprising:

a collar;

a skirt;

the skirt and collar including a split joint allowing the collar and skirt to be opened up, wrapped around an elongate member, and closed in a watertight manner with the collar generally above the skirt and secured thereto; and the collar being formed as a plug which is a separate piece from the skirt and is adapted to be fitted into an opening in the skirt, and the plug having a seam that allows the plug to open and wrap around the elongate member.

5. A waterproof roof deck post construction, comprising:

a deck post having a post cross-section and secured relative to a roof deck;

a sleeve surrounding a lower portion of the post;

a flange secured to a lower end of the sleeve and extending out therefrom, the flange being secured relative to the roof deck;

a waterproofing assembly including a collar and a skirt, the collar having an opening having generally the same cross-section as that of the post cross-section, the post being disposed in the opening, the collar surrounding the post above a top of the sleeve, and the skirt extending down from the collar and out over the top of the sleeve;

a band surrounding the collar and securing in a generally watertight manner the collar to the post; and a split joint on the collar and the skirt, the split joint including a female adapter and a male component which is snapped in place into the female adapter to secure the waterproofing assembly, the male component being detachable from the female adapter for retrofitting the waterproofing assembly;

wherein the post cross-section is non-circular.

6. The construction of claim 5 wherein the non-circular cross-section of the opening is a polygonal shape.

7. The construction of claim 5 wherein the non-circular shape is an L shape.

8. A waterproof roof deck post construction, comprising:

a deck post having a post cross-section and secured relative to a roof deck;

a sleeve surrounding a lower portion of the post;

a flange secured to a lower end of the sleeve and extending out therefrom, the flange being secured relative to the roof deck;

a waterproofing assembly including a collar and a skirt, the collar having an opening having generally the same cross-section as that of the post cross-section, the post being disposed in the opening, the collar surrounding the post above a top of the sleeve, and the skirt extending down from the collar and out over the top of the sleeve;

a band surrounding the collar and securing in a generally watertight manner the collar to the post; and a split joint on the collar and the skirt, the split joint including a female adapter and a male component which is snapped in place into the female adapter to secure the waterproofing assembly, the male component being detachable from the female adapter for retrofitting the waterproofing assembly;

wherein the collar comprises an elastomeric material.

9. A waterproof roof deck post construction, comprising:

a deck post having a post cross-section and secured relative to a roof deck;

a sleeve surrounding a lower portion of the post;

a flange secured to a lower end of the sleeve and extending out therefrom, the flange being secured relative to the roof deck;

a waterproofing assembly including a collar and a skirt, the collar having an opening having generally the same cross-section as that of the post cross-section, the post being disposed in the opening, the collar surrounding the post above a top of the sleeve, and the skirt extending down from the collar and out over the top of the sleeve;

a band surrounding the collar and securing in a generally watertight manner the collar to the post; and a split joint on the collar and the skirt, the split joint including a female adapter and a male component which is snapped in place into the female adapter to secure the waterproofing assembly, the male component being detachable from the female adapter for retrofitting the waterproofing assembly;

wherein the waterproofing assembly includes a top rim extending about a circumferential top outer edge of the collar.

10. The construction of claim 9 wherein the waterproofing assembly includes a circumferential shoulder interconnecting the collar and the skirt.

11. The construction of claim 10 wherein the waterproofing assembly is an EPDM molded rubber construction.

12. A waterproof roof deck post construction, comprising:

a deck post having a post cross-section and secured relative to a roof deck;

a sleeve surrounding a lower portion of the post;

a flange secured to a lower end of the sleeve and extending out therefrom, the flange being secured relative to the roof deck;

a waterproofing assembly including a collar and a skirt, the collar having an opening having generally the same cross-section as that of the post cross-section, the post being disposed in the opening, the collar surrounding the post above a top of the sleeve, and the skirt extending down from the collar and out over the top of the sleeve;

a band surrounding the collar and securing in a generally watertight manner the collar to the post; and a split joint on the collar and the skirt, the split joint including a female adapter and a male component which is snapped in place into the female adapter to secure the waterproofing assembly, the male component being detachable from the female adapter for retrofitting the waterproofing assembly;

wherein the collar is formed as a plug which is a separate piece from the skirt and is adapted to be fitted into an opening in the skirt.

13. A waterproof roof deck post construction, comprising:

a deck post secured to a roof deck;

a sleeve assembly wrapped around the post and having a seam thereof sealed closed, the sleeve assembly including a lower flange which is secured to the roof deck;

a waterproofing assembly including a collar and a skirt, and a split joint through the skirt and collar;

the collar surrounding the post above a top of the sleeve assembly, the skirt extending down from the collar and out over the top of the sleeve assembly, and the split joint is closed in a watertight manner;

a split joint including a female adapter and a male component which is snapped in place into the female adapter to secure the waterproofing assembly, the male component being detachable from the female adapter for retrofitting the waterproofing assembly; and a band surrounding the collar and securing in a generally watertight manner the collar to the post;

wherein the post cross-section is non-circular; and wherein the waterproofing assembly has a post receiving opening having a non-circular cross-section, corresponding to the non-circular cross-section of the deck post.

14. The construction of claim 13 wherein the non-circular cross-section of the opening is a polygonal shape.

15. A waterproof roof deck post construction, comprising:

a deck post secured to a roof deck;

a sleeve assembly wrapped around the post and having a seam thereof sealed closed, the sleeve assembly including a lower flange which is secured to the roof deck;

a waterproofing assembly including a collar and a skirt, and a split joint through the skirt and collar;

the collar surrounding the post above a top of the sleeve assembly, the skirt extending down from the collar and out over the top of the sleeve assembly, and the split joint is closed in a watertight manner;

a split joint including a female adapter and a male component which is snapped in place into the female adapter to secure the waterproofing assembly, the male component being detachable from the female adapter for retrofitting the waterproofing assembly; and a band surrounding the collar and securing in a generally watertight manner the collar to the post;

wherein the collar comprises a plug formed as a separate piece from the skirt and adapted to fit into an opening in the skirt.

16. A waterproof roof deck post construction, comprising:

a deck post secured to a roof deck;

a sleeve assembly wrapped around the post and having a seam thereof sealed closed, the sleeve assembly including a lower flange which is secured to the roof deck;

a waterproofing assembly including a collar and a skirt, and a split joint through the skirt and collar;

the collar surrounding the post above a top of the sleeve assembly, the skirt extending down from the collar and out over the top of the sleeve assembly, and the split joint is closed in a watertight manner;

a split joint including a female adapter and a male component which is snapped in place into the female adapter to secure the waterproofing assembly, the male component being detachable from the female adapter for retrofitting the waterproofing assembly; and a band surrounding the collar and securing in a generally watertight manner the collar to the post;

wherein the sleeve assembly includes a watertight flap which secures the split joint closed.

17. A waterproofing assembly, comprising:

a collar;

a skirt;

the skirt and collar including a split joint allowing the collar and skirt to be opened up, wrapped around an elongate member, and closed in a watertight manner with the collar generally above the skirt and secured thereto; and the split joint including a female adapter and a male component which is snapped in place into the female adapter to secure the waterproofing assembly, the male component being detachable from the female adapter for retrofitting the waterproofing assembly;

wherein the collar and skirt are formed as two separate pieces with the collar defining a plug which fits into an opening of the skirt.

18. The assembly of claim 17 wherein the plug has a through-opening with a non-circular cross-section.

19. The assembly of claim 18 wherein the non-circular cross-section is an L shape, a rectangular shape, a polygonal shape, a T shape or a U shape.

20. A method of constructing a waterproof roof deck post construction, comprising:

(a) securing a deck post having a post cross-section to a roof deck;

(b) securing a sleeve positioned over and surrounding the post to a roof deck;

(c) providing a waterproofing assembly including a collar and a skirt, the collar having an opening which has generally the same cross-section as that of the post cross-section;

(d) positioning the waterproofing assembly such that the deck post extends through the collar opening and the skirt extends down over a top of a pipe jack;

(e) snapping a male component into a female adapter to position the waterproofing assembly relative to the deck post; and (f) after (d), applying a band around the collar to secure the collar in a generally watertight manner to the post;

wherein the collar has an opening with a non-circular cross-sectional shape which corresponds to a cross-sectional shape of the post.

21. A method of constructing a waterproof roof deck post construction, comprising:

(a) securing a deck post having a post cross-section to a roof deck;

(b) securing a sleeve positioned over and surrounding the post to a roof deck;

(c) providing a waterproofing assembly including a collar and a skirt, the collar having an opening which has generally the same cross-section as that of the post cross-section;

(d) positioning the waterproofing assembly such that the deck post extends through the collar opening and the skirt extends down over it top of a pipe jack;

(e) snapping a male component into a female adapter to position the waterproofing assembly relative to the deck post; and (f) after (d), applying a band around the collar to secure the collar in a generally watertight manner to the post;

wherein the collar comprises a plug which is a separate piece from the skirt, and further comprising inserting the plug into an opening in the skirt.

* * * * *